United States Patent [19]

Takasaki

[11] Patent Number: 4,486,041

[45] Date of Patent: Dec. 4, 1984

[54] DOOR HANDLE UNIT

[75] Inventor: Kunihiko Takasaki, Tokyo, Japan

[73] Assignee: Takigen Seizou Co., Ltd., Tokyo, Japan

[21] Appl. No.: 475,873

[22] Filed: Mar. 16, 1983

[30] Foreign Application Priority Data

Mar. 23, 1982 [JP] Japan ..... 57-39456[U]

[51] Int. Cl.[3] ..... E05C 3/08

[52] U.S. Cl. ..... 292/221; 292/336.3

[58] Field of Search ..... 292/221, 122, 123, 336.3, 292/347, DIG. 37

[56] References Cited

U.S. PATENT DOCUMENTS 2,003,731 6/1935 Beito ..... 292/221

2,316,401 4/1943 Burke ..... 292/221

*Primary Examiner*—Richard E. Moore

*Attorney, Agent, or Firm*—Martin Smolowitz

[57] ABSTRACT

A door handle unit in which a movable handle is linearly slidably fitted in a case secured to a door, a latch coming into engagement with and disengagement from a keeper secured to a fixed frame member is pivoted to the case, engagement of the keeper and the latch is held by means of a spring for urging the latch to be rotated, an actuating link coupled to an inner end portion of the movable handle is engaged with the latch, and the latch is disengaged from the keeper along with a linear pulling movement of the movable handle.

Since the movable handle is operated in a linear sliding manner, there do not occur troubles of breakage or distortion in the handle unit.

3 Claims, 3 Drawing Figures

DOOR HANDLE UNIT

FIELD OF THE INVENTION

This invention relates to a door handle unit which includes therein a mechanism for locking doors of freezers, refrigerators, etc. to fixed frame members such as a compartment body.

BACKGROUND OF THE INVENTION

The conventional door handle unit disclosed in Japanese Utility Model Laid Open No. 55-109758 is constructed as follows. The handle unit comprises a case secured to a door, a keeper attached to a fixed frame member, a lever type handle having one end portion pivoted to the case, and a latch slidably fitted within the case and coming into engagement with and disengagement from the keeper. And an actuating projection formed at the pivoted end portion of the handle is engaged with the latch.

In the door handle unit of this type, when the handle is pulled to rotate the actuating projection and retreat the latch toward the case side, engagement of the latch with the keeper is released. However, since such a lever type handle includes the lever having a long arm, an excessive force acts on the pivoted portion of the handle or the thin walled portion and the notched portion in the vicinity thereof. Thus, there may occur troubles of breakage or distortion in not a few cases. This breakage or distortion problem has become recently more and more serious with an increase in size and weight of doors for refrigerators, freezers, etc. To solve such problems it has been proposed to change materials or to modify a shape and construction of handles in various manners.

SUMMARY OF THE INVENTION

It is an object of this invention to provide a door handle unit which is operated not in a lever rotating manner but in a sliding manner, so as to avoid troubles of breakage or distortion oftenly occurred in the prior art, thus ensuring good properties in both ruggedness and durability for the handle unit.

The door handle unit according to this invention comprises; a case secured to a door; a keeper attached to a fixed frame member such as a compartment body; a movable handle linearly slidably fitted in the case; a latch pivoted to the case and coming into engagement with and disengagement from the keeper; an actuating link having one end portion coupled to an inner end portion of the movable handle; and a spring adapted to urge and rotate the latch in the direction to be engaged with and held by the keeper, in which the latch is operatively engaged with the actuating link and the latch is rotated along with a linear pulling movement of the movable handle, thereby to release engagement of the latch with the keeper.

In the following, this invention will be described in detail with reference to the accompanying drawings which show a preferred embodiment of the invention.

DETAILED DESCRIPTION OF THE INVENTION

Figure 1:
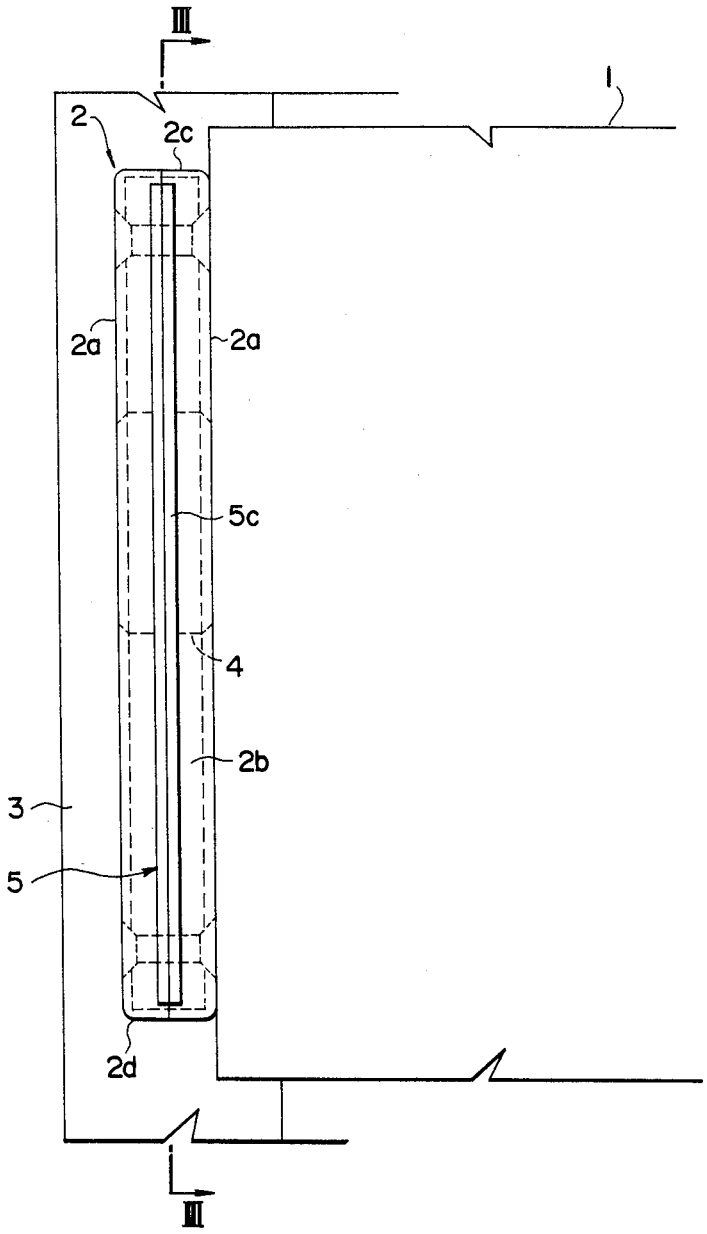
FIG. 1 is a front view of a door handle unit according to this invention.
Figure 2:
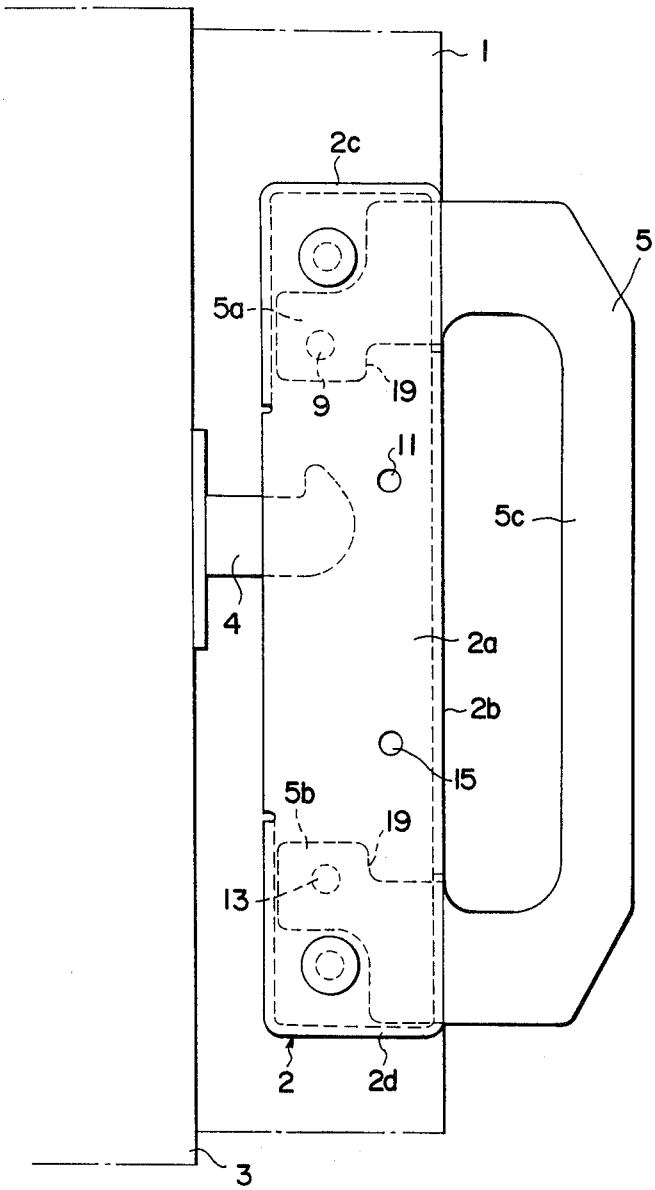
FIG. 2 is a left side view of the door handle unit in FIG. 1.
Figure 3:
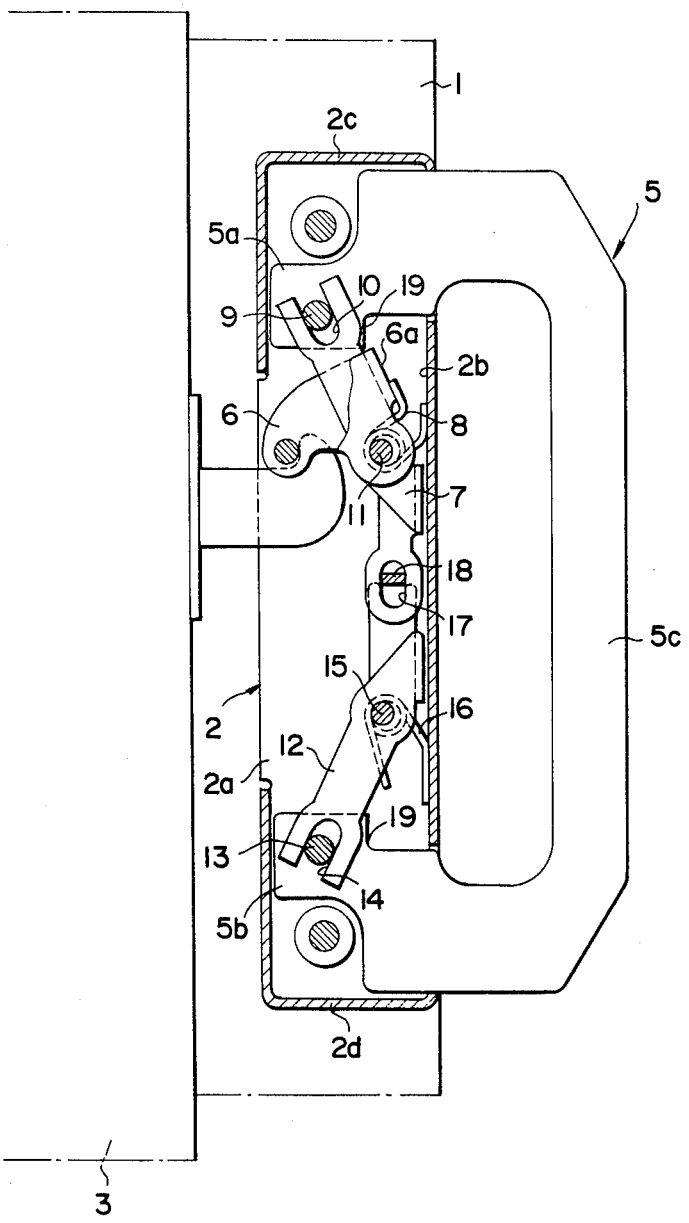
FIG. 3 is a sectional view taken along the line III—III in FIG. 1.

As illustrated in FIGS. 1 to 3, a movable handle 5 is formed into a shape of U and its two leg portions 5*a* and 5*b* are linearly slidably fitted in a case 2 which is secured to a door 1. One leg portion 5*a* has an inner end portion to which is secured an interlocking pin 9. In one end portion of an actuating link 7 is formed an elongated hole or a receiving slot 10 in which is loosely fitted the pin 9 to be movable. Both a latch 6 and the actuating link 7, the latch 6 coming into engagement with and disengagement from a keeper 4 attached to a fixed frame member 3, are pivoted to a side wall portion 2*a* of the case 2 by means of a common pin 11, and a torsion coil spring 8 is fitted over the pin 11. This spring 8 has one end thereof in pressure-contact with a front wall portion 2*b* of the case 2 and the other end thereof in pressure-contact with the outer surface of a central connecting portion 6*a* of the latch 6. By virtue of the spring 8, the latch 6 is urged to rotate in the direction to be engaged with and held by the keeper 4. The actuating link 7 abuts against the inner surface of the central connecting portion 6*a* of the latch 6.

An interlocking link 12 similar to the actuating link 7 is coupled to the inner end portion of the other leg portion 5*b* of the movable handle 5 through a pin 13. The pin 13 is loosely fitted in a receiving slot 14 formed at one end portion of the link 12 so as to be movable within it. A torsion coil spring 16 is fitted over a pin 15 adapted to pivotably secure the actuating link 12 to the case side wall portion 2*a*, and it urges the movable handle 5 to slide inward through the pin 15. The other end portions of both actuating link 7 and interlocking link 12 are connected to each other through an elongated hole 17 formed in the former link and a projection 18 formed on the latter link to be loosely fitted in the hole 17 in a movable relation.

In the door handle unit thus arranged, when the movable handle 5 is pulled in attempting to open the door, the movable handle 5 linearly slides with its leg portions 5*a* and 5*b* being guided by upper and lower wall portions 2*c* and 2*d* of the case, respectively. Along with this linear pulling movement of the movable handle 5, both actuating link 7 and interlocking link 12 are rotated outward in opposite directions about the pins 11 and 15 against resilient forces of the springs 8 and 16, respectively. This outward rotation of the actuating link 7 allows the latch 6 to be rotated about the pin 11 outward, i.e., in the clockwise direction in FIG. 3, so that the latch 6 is disengaged from the keeper 4. As a result, the locked state of the door 1 with respect to the fixed frame member 3 is released and hence the door 1 becomes openable.

When the movable handle 5 is released from its hold after opening of the door, both actuating link 7 and interlocking link 12 are returned to their original positions by the action of the springs 8 and 16, respectively, and the latch 6 assumes such a position as permitting its automatic engagement with the keeper 4 when the door 1 is closed subsequently. Each of the leg portions 5*a* and 5*b* of the movable handle 5 has a stopper surface 19 at its front portion, which surface is brought into abutment against the inner surface of the front wall portion 2*b* of the case 2, thereby to prevent the movable handle 5 from slipping out of the case 2.

According to the door handle unit of this invention, as fully described in the above, the movable handle 5 is linearly slidably fitted in the case 2, one end portion of the actuating link 7 pivoted to the case 2 is coupled to the inner end portion of the movable handle 5, the latch 6 pivoted to the case 2 is engaged with the actuating link 7, and both actuating link 7 and latch 6 are rotated against a resilient force of the spring 8 along with the linear pulling movement of the movable handle 5 so as to release engagement of the latch 6 with the keeper 4. Thus, unlike the conventional door handle using lever rotating type handles, there is no fear that constituent members may be subjected to troubles of breakage or distortion, and at the same time the entire handle unit has the rugged construction and superior durability. Furthermore, since the locked state of the door 1 with respect to the fixed frame member 3 is released just by pulling the movable handle 5 out of the case 2 linearly, unlocking and opening of the door can be effected continuously by a single operation, thus resulting in the convenient operation.

Particularly, in the above-mentioned embodiment, the other leg portion **5*b* of the movable handle 5 is also coupled to the interlocking link 12 which in turn is in conjunction with the acturating link 7, the door is unlocked assuredly even when grasping any part of a grip portion 5*c* of the movable handle 5**.

What is claimed is:

1. A door handle unit comprising; a case secured to a door; a keeper attached to a fixed frame member such as a compartment body; a movable handle linearly slidably fitted in said case; a latch pivoted to said case and coming into engagement with and disengagement from said keeper; an actuating link having one end portion coupled to an inner end portion of said movable handle; and a spring adapted to urge and rotate said latch in the direction to be engaged with and held by said keeper, in which said latch and said actuating link are operatively engaged with each other, and said latch is rotated against a resilient force of said spring along with a linear pulling movement of said movable handle, thereby to release engagement of said latch with said keeper.

2. A door handle unit according to claim 1, including an interlocking link having one end portion coupled to an inner end portion of said movable handle and the other end portion pivotably connected to said actuating link, whereby a linear pulling movement of said movable handle causes said interlocking link to rotate outwardly and release engagement of the latch with the keeper.

3. A door handle unit according to claim 2, wherein a torsion coil spring is provided in contact with said interlocking link and adapted to urge and rotate said interlocking link in the direction so that the latch is engaged with the keeper.

* * * * *